United States Patent [19]

Shaw

[11] 4,135,646

[45] Jan. 23, 1979

[54] APPARATUS FOR DISPENSING FLUIDS

[76] Inventor: Frances M. Shaw, 2100 Winrock #12, Houston, Tex. 77057

[21] Appl. No.: 767,204

[22] Filed: Feb. 9, 1977

[51] Int. Cl.[2] ..... B05B 7/30

[52] U.S. Cl. ..... 222/144; 239/305

[58] Field of Search ..... 222/144, 144.5, 193, 222/142.9; 239/305, 318, 310; 285/321, 330; 220/319; 137/101.11

[56] References Cited

U.S. PATENT DOCUMENTS

| | | | |
|---|---|---|---|
| 1,925,962 | 9/1933 | Hoyer | 222/144.5 X |
| 3,446,438 | 5/1969 | Watson | 239/318 X |
| 3,759,284 | 9/1973 | Crowley et al. | 239/310 X |
| 3,797,747 | 3/1974 | Buzzi et al. | 239/318 X |
| 3,992,117 | 11/1976 | Risrau | 285/321 X |

*Primary Examiner*—Allen N. Knowles

*Assistant Examiner*—Fred A. Silverberg

*Attorney, Agent, or Firm*—Browning, Bushman, & Zamecki

[57] ABSTRACT

Disclosed is apparatus for dispensing a fluid from a container by introducing the fluid at a relatively low flow rate into a primary fluid flow conducted by an adjacent conduit. In the embodiment shown, a housing equipped with multiple chambers for holding different fluids may be manipulated relative to the conduit for selectively communicating fluid from one of the chambers along a passage leading to the primary flow. The conduit is shaped to reduce the cross-sectional area of the primary flow at the point of intersection with the passage. Atmospheric pressure propels the fluid from the selected chamber along the passage and into the primary fluid flow.

19 Claims, 7 Drawing Figures

APPARATUS FOR DISPENSING FLUIDS

BACKGROUND OF THE INVENTION

1. Field of the Invention

The present invention relates to apparatus for dispensing fluid material. More particularly, the present invention pertains to apparatus for dispensing fluids from one or more sources by introducing such fluids in small quantities into a primary fluid flow. The fluids to be dispensed are thus mixed with and carried by the fluid of the primary fluid flow. The mixture may then be sprayed, for example, thus distributing a selected concentration of the fluid to be dispensed along with the greater quantity of the fluid originally in the primary fluid flow.

2. Description of the Prior Art.

The concept of dispensing a material in relatively small concentrations by introducing the material in small quantities into a primary fluid flow is well known. Currently, small cakes, or other solid forms of material to be so dispensed, may be placed in a housing in line with the water flow in a garden hose. As the water flows by the solid material, small quantities of the solid are picked up by the water stream, and are carried off with the water and thereafter ejected from the nozzle of the garden hose. In this way, a relatively low concentration of soap, for example, mixed with water may be sprayed for use in washing a large area, such as an automobile or a house. Other solid materials such as wax, herbicides, or fertilizer, may also be so dispensed. A variation of this technique includes placing the material to be dispensed in a housing adjacent the conduit carrying the water flow, and selectively permitting a small amount of water to be circulated through the housing. While in the housing, this small quantity of water dissolves a portion of the solid material to be dispensed, and carries off the dissolved solid material and introduces it back into the main water flow. With devices of this type, it is a relatively simple matter to interrupt the diversion of water into the housing in order to cease dispensing the solid material with the main water flow. Such apparatus may be incorporated into the plumbing of an ordinary shower.

When the material to be dispensed is in the form of a fluid, the mechanism of an aspirator may be employed to introduce the fluid to be dispensed into the primary fluid flow, or carrier. It is well known that the pressure along a flow of incompressible fluid decreases as the velocity of the flow increases. Bernoulli's equation describes this effect. By establishing a sufficiently fast primary fluid flow, fluid from an adjacent source may be propelled by the pressure of the atmosphere into the primary fluid flow at the point of low pressure therein. Thus, a rapid stream of air picks up and carries off perfume vapor in the case of a perfume aspirator bottle. Similarly, water passing along a garden hose carries off liquid soap, etc., introduced into the garden hose water flow from an adjacent bottle. In both of these examples of aspirator techniques, the cross-sectional area of the primary fluid flow may be reduced, as in a Venturi tube, at the point the fluid to be dispensed is introduced into the primary fluid flow, to ensure having a sufficiently high fluid velocity, and, consequently, a sufficiently low pressure, at that point.

It will be appreciated that a fluid-tight connection must be maintained between the container providing the fluid to be dispensed and the conduit carrying the primary fluid flow in order for the pressure of the atmosphere to effectively propel the fluid to be dispensed into the primary fluid flow in the aspirator devices. Indeed, such dispensing of fluids may be interrupted by opening the conduit to the atmosphere at the point where the fluid to be dispensed is introduced into the primary fluid flow. Consequently, practical and efficient devices, using the aspirator technique for dispensing fluids, are not readily available whereby a plurality of fluids to be dispensed may be provided, with one or another of the fluids selected at will for dispensing.

SUMMARY OF THE INVENTION

The dispensing apparatus of the present invention includes a conduit for conducting a first, or a primary, fluid flow. The fluid, or fluids, to be dispensed are maintained in a housing adjacent the conduit. The fluid of the primary fluid flow, as well as the fluid to be dispensed, may be any material exhibiting fluid properties, including liquids, gases and slurries. A passage is provided for selectively conducting a second fluid flow from the housing through the wall of the conduit for selectively introducing fluid to be dispensed into the first fluid flow. Control means is selectively movable between a first configuration, in which said second fluid flow is so established, and a second configuration, in which said second fluid flow is interrupted.

The housing includes a cap device and a canister. The latter element is equipped with a plurality of chambers for maintaining supplies of different types of fluids to be dispensed. The canister is separable from the cap device for filling the chambers, and for general maintenance. The cap device includes throughbores, or paths, for conducting fluid to be dispensed from the chambers to the passage through the conduit wall. The paths are continued within the housing in tubes which reach to the bottom of the chambers when the canister and the cap device are joined together. Thus, fluid from the bottom of the chambers moves along the tubes through the paths in the cap device to the passage when the second fluid flow is established. Sealing apparatus joins the passage with a selected path in the cap device to complete the fluid-tight flow path from the corresponding tube in the selected chamber to the exit of the passage within the conduit at the primary fluid flow.

A base is fixed adjacent to the conduit for positioning the housing by releasably connecting to the cap device. The cap device is thus removable from the base for maintenance of both the housing as well as the conduit and base. While connected to the base, the housing, and, therefore, the cap device, is movable relative to the conduit to selectively join the sealing apparatus to the cap device at one or another of the paths. Thus, the control means includes the cap device and the base to which it is joined, and is operable by manipulation of the housing relative to the conduit.

The apparatus of the present invention is particularly applicable to shower devices whereby the dispensing apparatus may be used to introduce soap, oil, or other desirable materials into the water stream sprayed from a shower heat. Thus, the conduit is positioned in line along the water pipe leading to the shower head, and carries the water stream supplied by the water pipe as the primary fluid flow. The housing may be constructed so that it is readily connected to, and disconnected from, the base so that the user may easily service the apparatus. Similarly, the manipulation of the housing to selectively introduce one or another of the fluids to be dispensed into the shower stream may be readily carried out by one using the shower, and suffering from wet and soapy hands. The present invention as applied to shower dispensers has the additional advantages of being easily installed on existing equipment, and being made in a relatively simple and inexpensive fashion.

DESCRIPTION OF THE PREFERRED EMBODIMENTS

Figure 1:
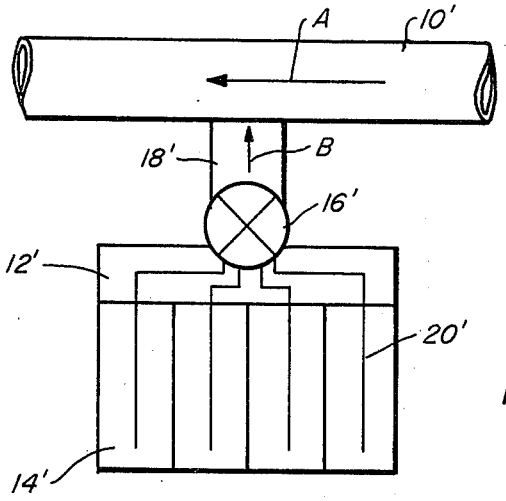
FIG. 1 is a schematic illustration of a multichamber device for selectively dispensing fluids by introducing them into a primary fluid flow.

The dispenser of the present invention is shown schematically in FIG. 1, where primed numbers indicate that the elements are shown schematically only. A conduit 10′ is provided for conducting a first fluid flow, as indicated by arrow A. A housing 12′ contains a plurality of chambers 14′ for storing fluids to be dispensed. A control means 16′ selectively connects one or another of the chambers 14′ with a second passage 18′ leading to the interior of the conduit 10′. The second passage 18′ conducts a second fluid flow, indicated by the arrow B, from the selected chamber 14′ into the first fluid flow A in the conduit 10′. Within the housing 12′, appropriate connecting tubes 20′ are provided for communicating the fluid from the chambers 14′ to the control means 16′ as selected. It will be appreciated that variations in construction of the dispenser are possible within the scope of the present invention. For example, the control means 16′ may be any device which will selectively connect at least one of the chambers 14′ with the second passage 18′. Also, the control device is capable of preventing any communication of fluid from the chambers 14′ to the second passage 18′, when that condition is desired. Thus, the control means 16′ may be a valve, or a valve in conjunction with additional appropriate apparatus, or any type of selective connecting device suitable for performing the function of the control means of the present invention as described herein.

Figure 2:
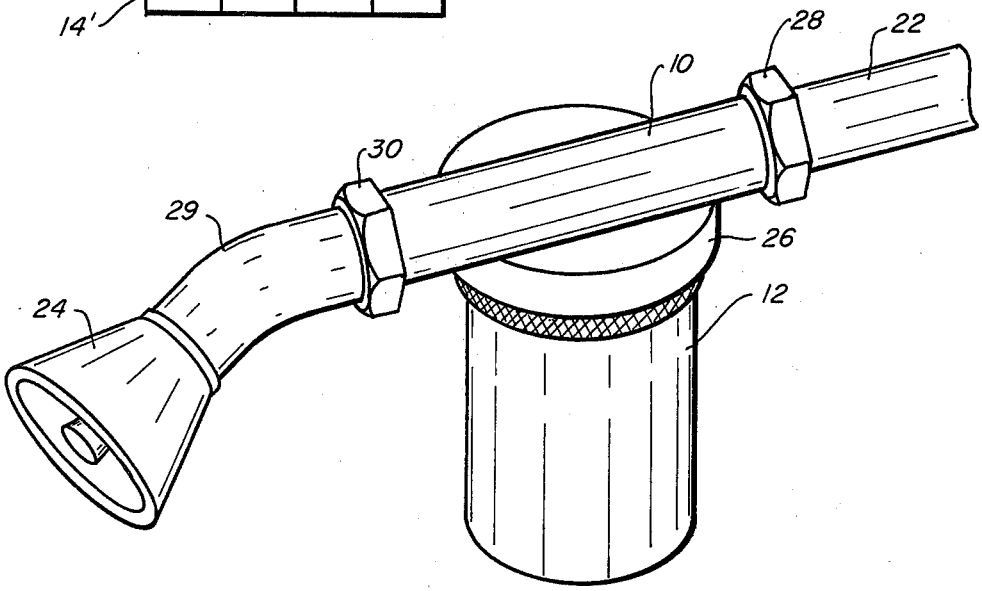
FIG. 2 is a perspective view of the dispenser of the present invention as applied to a shower facility.

FIG. 2 shows the present invention in the form of a shower dispenser. Elements corresponding to those shown schematically in FIG. 1 are hereinafter indicated without primes. The conduit 10 is placed in line between a water pipe 22 and the shower head 24, and carries, as its primary fluid flow, the water ordinarily supplied to the shower head. The housing 12 is suspended from a base 26, which is fixed to the conduit 10. Fittings 28 and 30 join the conduit 10 to the water pipe 22 and a pipe segment 29 leading to the shower head 24, respectively. As will be more fully described hereinafter, one using the shower may readily select one or another of the fluids contained within the housing 12 to be dispensed through the shower head 24 with the primary fluid flow, or choose no fluid to be dispensed, by manipulating the housing 12 relative to the base 26 and, therefore, the conduit 10. Details of the control means, not readily apparent in FIG. 2, as well as other elements of the shower dispenser, may be appreciated by reference to FIGS. 3–7.

A segment of the conduit 10 is equipped with a reduced interior cross-sectional area, indicated at 10*a*. As noted hereinbefore, the pressure in the primary fluid flow through the conduit 10 is decreased where the velocity of the flow is increased. Also, since the water being conducted by the conduit 10 is virtually imcompressible, a reduction in conduit cross-sectional area requires the flow rate of the fluid flow to increase at the reduced area segment. Consequently, the pressure within the conduit 10 is lowest in the reduced area section 10*a*. It is in this reduced area section 10*a* that the passage 18 conducting the second fluid flow intersects the interior of the conduit 10.

Figure 6:
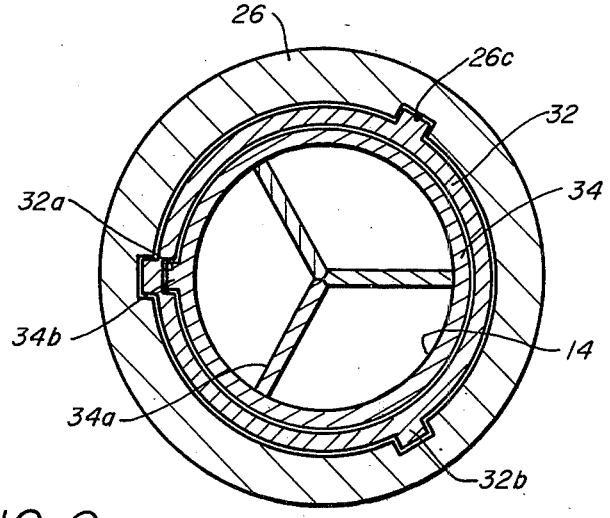
FIG. 6 is a horizontal cross-section taken along the lines 6—6 of FIG. 3.
Figure 3:
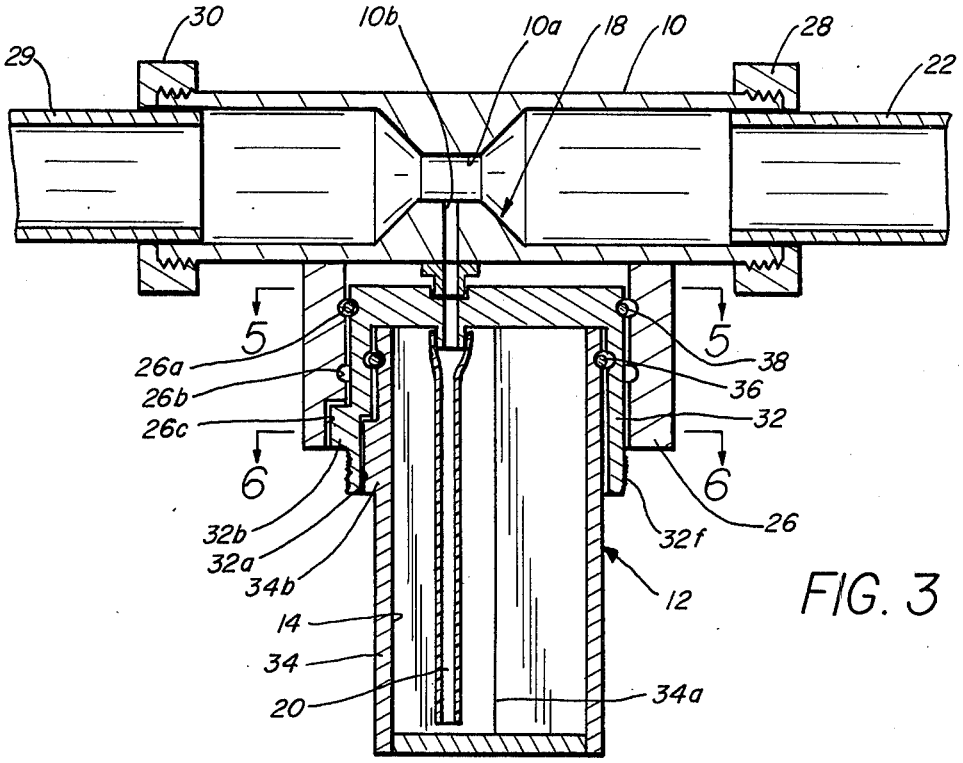
FIG. 3 is a cross-sectional view of a shower dispenser of the present invention, illustrating the first configuration of the control means in which the second fluid flow may be conducted.

The housing at 12 includes a cap device 32 and a canister 34. The interior of the canister 34 is divided by walls 34*a* into the elongate chambers 14 as shown in FIGS. 3 and 6. While three such chambers 14 are illustrated, any number of chambers, including just one, may be employed. The cap 32 is in the form of an inverted cup which receives the top of the canister 34. A split ring, or snap ring, 36 cooperates with appropriate annular grooves in the interior surface of the cap 32 and the exterior surface of the canister 34 to releasably anchor, or hold, the canister longitudinally fixed relative to the cap. A lug 34*b* projecting from the exterior side of canister 34 meshes with a slot 32*a* on the interior surface of the cap 32 when the canister is inserted with the cap. Thus, the lug 34*b* and slot 32*a* constitute a key means for permitting the canister 34 to be inserted within the cap 32 in only one rotational orientation relative to the cap. To join the canister 34 to the cap 32 then, the top of the canister is inserted within the cap with the lug 34*b* aligned with the slot 32*a*, and the two housing elements are moved together until the snap ring 36 is held within the appropriate grooves. It will be appreciated that the snap ring 36 may be fitted to be carried by either the canister 34 or the cap 32. Also, since the snap ring 36 is in the form of a split ring, and is not designed to function as a seal between the two housing elements, atmospheric pressure communicates to the interior of the canister 34 when the latter is held by the snap ring to the cap 32.

A snap ring 38, also in the form of a split ring, is used to similarly position and releasably anchor the cap 32 translationally within the base 26. However, the base 26 is equipped with two annular grooves for receiving the snap ring 38: an upper groove 26*a*; and a lower groove 26*b*. While a single snap ring 38 is shown carried by the cap 32 for releasable anchoring in either of the two base grooves 26*a* and 26*b*, it will be appreciated that the base grooves might each carry a separate snap ring for reception within the single groove of the cap 32. As in the case of the releasable anchoring of the canister 34 within the cap 32 by the snap ring 36, the anchoring of the cap within the base 26 by the snap ring 38 is effected without sealing occurring between the cap and the base. Thus, atmospheric pressure may still communicate with the region above the cap 32 within the base 26 and the adjacent exterior surface of the conduit 10.

Figure 4:
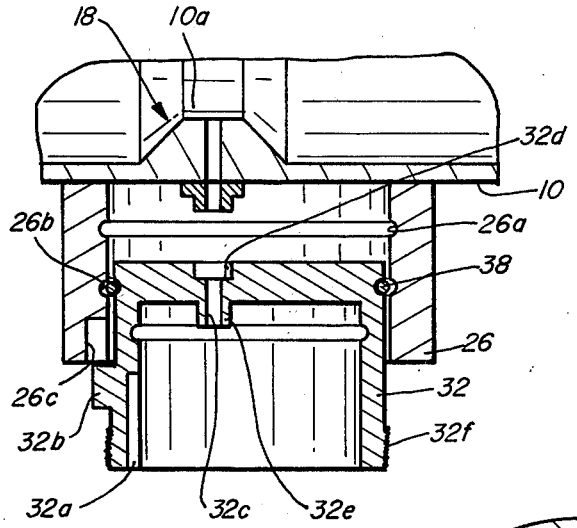
FIG. 4 is a partial cross-sectional view similar to FIG. 3, indicating the second configuration of the control means.

The cap 32, and, therefore, the entire housing 12, is movable within the base 26 between a first translational position, illustrated in FIG. 3, and a second translational position shown in FIG. 4. In both instances, the snap ring 38 releasably anchors the housing 12, through the cap 32, against translational motion relative to the base 26 and, therefore, the conduit 10. Thus, in the first translational position, the snap ring 38 engages the upper base groove 26*a*; in the second translational position, the lower groove 26*b*. The cap 32, with or without the canister 34 attached, may be joined to the base 26 by simply inserting the cap within the interior of the base and moving the cap toward the conduit until the snap ring 38 engages one or another of the grooves 26*a* or 26*b*. The cap 32 may be similarly withdrawn from the base 26 by pulling the cap in a direction away from the conduit, with the snap ring 38 releasing its engagement with the grooves 26*a* or 26*b*.

A plurality of lugs 32*b* on the exterior of the cap 32 mesh with an equal number of slots 26*c* lining the interior of the base 26 when the housing 12 is in the first translational position illustrated in FIG. 3. Then, the housing 12, through the cap 32, is held rotationally fixed relative to the base 26 and, therefore, the conduit 10. When the housing 12 is in the second translational position illustrated in FIG. 4, the lugs 32*b* are clear of the slots 26*c*, and the housing 12 is free to rotate about its longitudinal axis relative to the base 26 and the conduit 10. Thus, with the housing 12 in a second translational position illustrated in FIG. 4, the housing may be rotated relative to the base 26 and the conduit 10 until the desired alignment of lugs 32*b* with slots 26*c* is achieved. Then, the housing may be moved to the first translational position illustrated in FIG. 3. It will be appreciated, by reference to FIG. 6, that the number of lugs 32*b* and slots 26*c* employed in a given application of the present invention is equal to the number of chambers 14 present in the canister 34. However, the key apparatus including the lugs 32*b* and slots 26*c*, as well as the aforementioned key apparatus including the lug 34*b* on the canister 34 and the slot 32 a on the cap 32, may each be varied. For example, the relative positions of the lugs and slots in each case may be reversed. Also, to key rotational positions of the cap 32 relative to the base 26, only one lug 32*b* need be employed with an appropriate number of slots 26*c* to match the number of chambers 14 present in the canister 34. Other variations of keying apparatus may be employed within the scope of the present invention.

The cap 32 is equipped with a number of paths, or throughbores, 32*c* equal in number to the chambers 14 present in the canister 34. Each path 32*c* is equipped with an upwardly facing annular shoulder 32*d*, and is bordered by a downwardly-projected lip 32*e*. A tube 20 is frictionally held to each lip 32*e*, and extends downwardly to the vicinity of the bottom of each chamber 14 when the canister 34 is engaged, by way of the snap ring 36, with the cap 32. The friction fit between each tube 20 and the corresponding lip 31*e* is also relatively fluid-tight, so that fluid may pass upwardly through the path 32*e* only after passing along the length of the corresponding tube 20.

Figure 7:
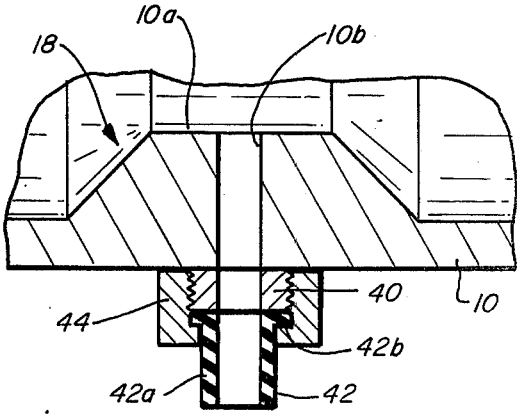
FIG. 7 is an enlarged cross-sectional view of the sealing apparatus of the present invention.
Figure 5:
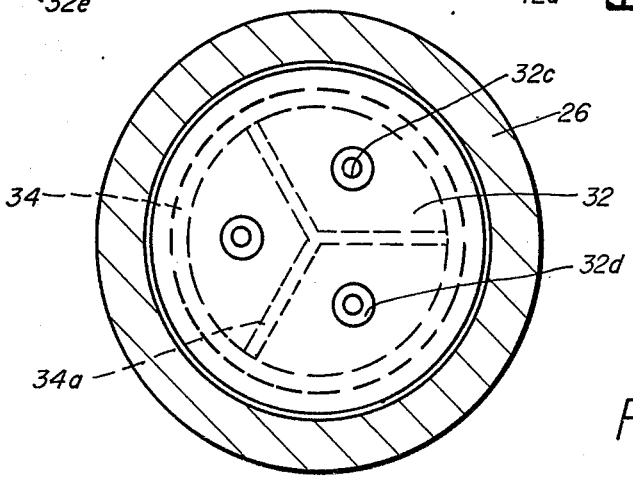
FIG. 5 is a horizontal cross-section taken along the lines 5—5 of FIG. 3.

The second passage 18 includes a throughbore 10*b* extending radially outwardly from the reduced area conduit section 10*a*, and is continued through an externally threaded fitting 40, fixed to the conduit 10 and best seen in FIG. 7. A tubular sealing member 42, including a shank 42*a* and an annular flange 42*b*, is held to the fixture 40 by a nut 44 which encloses the flange 42*b* against the fixture. The shank of the seal 42*a* extends downwardly to communicate the throughbore 10*b* of the passage with the housing 12. Thus, when the housing 12 is in the first translational position illustrated in FIG. 3, one of the paths 32*c* through the cap 32 is aligned with the throughbore 10*b* and its continuation through the fixture 40 and the sealing member 42. Such an alignment is guaranteed by the keying operation of the lugs 32*b* and the slots 26*c*. It will be appreciated, that, that whenever the cap 32 is rotationally oriented relative to the base 26*c* and the conduit 10 to be permitted, by the lugs 32*b* and slots 26*c*, to move into the first translational position illustrated in FIG. 3, one of the paths 32*c* will be so aligned with the passage 18 that, when the cap is in the first translational position, the sealing member shank 42*a* will extend downwardly within the path 32*c* and abut the shoulder 32*d*. The sealing member 42 is made of resilient sealing material, such as rubber or nylon, and thus establishes a fluid-tight seal with the cap 32. Then, the seal acts to communicate fluid moving along the corresponding tube 20 through the path 32*c*, to the interior of the conduit 10, by way of the throughbore 10*b*. When the cap 32, and, therefore, the housing 12, is lowered to the second translational position illustrated in FIG. 4, the path 32*c* is pulled away from the seal member 42 leaving the seal member free of fluid-tight connection with the cap. Also, as noted hereinbefore, the lugs 32*b* are then clear of the slots 26*c* of the base 26 and the housing 12 is free to be rotated to align any one of the paths 32*c*, corresponding to a particular chamber 14, with the passage 18. To then reconnect the passage 18 to the tube 20 and the selected chamber 14, the housing is moved back into the first translational position, with the lugs 32*b* appropriately aligned with the slots 26*c* in the newly selected rotational orientation of the housing 12 relative to the base 26 and the conduit 10. To facilitate the movement of the housing 12, the lower external region of the cap 32 is equipped with a knurled surface 32*f*.

The housing 12 may be completely removed from the base 26, and the canister 34 may be separated from the cap 32. Thus, one or more of the chambers 14 may be supplied with fluid to be dispensed by simply pouring such fluid into the top of the canister when the later is removed from the cap 32. The canister 34 is then rotationally aligned with the cap 32, that is, the lug 34*b* is aligned with the slot 32*a*, and the canister is inserted into the cap 32 until the two elements are held translationally relative to each other by the snap ring 36. The combination of the lug 34*b* and the slot 32*a* holds the canister 34 against rotational motion relative to the cap 32. It will be appreciated that the tubes 20 may remain held to the cap 32 by the lips 32*e* whenever the canister 34 is removed from the cap. Then, each tube must be placed within its corresponding chamber 14 in order to appropriately rotationally align the canister 34 relative to the cap when the housing 12 is being reassembled. It will also be appreciated that the canister 34 may be removed from, or joined to, the cap 32 whether or not the cap is held within the base 26, and also regardless of which of the two translational positions the cap is in relative to the base and the conduit 10.

With the housing 12 in its assembled configuration, it may be retained in the second translational position of FIG. 4, if it is not desired to dispense fluid into the first fluid flow of the shower. In order to carry out the dispensing of such fluid, the housing is simply rotated in its second translational position until the chamber 14 containing the fluid desired to be dispensed is in position so that the corresponding path 32*c* is aligned with the passage 18. This can be readily done by grasping either the canister 34 or the knurled portion of the cap 32, and rotating appropriately. Then, the housing 12 is pushed toward the conduit 10 until the housing is moved into its first translational position of FIG. 3. In this instance, the sealing member 42 engages the shoulder 32*d* within the path 32*c* corresponding to the chamber 14 containing the fluid selected to be dispensed. With the first fluid flow established along the conduit 10, atmospheric pressure then operates on the surface of the fluid to be dispensed within the appropriate chamber 14, forcing the fluid through the tube 20 into passage 18 and into the low-pressure conduit region 10*a*. Obviously, the speed with which the fluid will be so propelled into the primary fluid flow will depend upon the pressure within the reduced area segment 10*a*, determined by the velocity of flow of the first fluid flow therethrough, as well as the density of the fluid to be dispensed. However, it will be appreciated that the primary fluid flow generally occurs at a relatively large flow rate. Therefore, the fluid to be dispensed generally emerges from the shower head 24 as a relatively low percentage of the total fluid emerging therefrom.

When it is desired to cease the dispensing of the fluid from the selected chamber 14, the cap 32 is simply withdrawn from the first translational position of FIG. 3 to the second translational position of FIG. 4, breaking the fluid-tight seal between the sealing member 42 and the path 32*c*. Then, atmospheric pressure may act directly through the passage 18, and only the water of the primary fluid flow will emerge from the shower head 24. The housing 12 may be rotated to align the path 32*c* corresponding to a different chamber 14 with the passage 18, and returned to the first translational position, or left in the second translational position.

The term "fluids" as used herein to describe the material to be dispensed by the apparatus of the present invention includes any substance generally exhibiting fluid properties. Thus, by way of example, and not limitation, the present invention may be used with liquids or slurries. Also, solid material may be placed with liquids in the chamber 14 with appropriate solvent, and the resultant solution dispensed with the first fluid flow. Vapors may also be dispensed with the present invention.

It will be appreciated from the foregoing description that the control means, illustrated schematically as 16 in FIG. 1, includes the cap 32 and the base 26 in the shower dispenser embodiment illustrated in detail in FIGS. 2–7. Thus, when the housing 12 is in the first translational position of FIG. 3, the control means is in its first configuration in which the second fluid flow is established along the passage 18. when the housing 12 is in the second translational position of FIG. 4, the control means is in its second configuration, in which the second fluid flow along the passage 18 is interrupted.

When the canister 34 contains but a single chamber for providing fluid to be dispensed, the cap 32 may be equipped with but one path 32*c*. Then, the path 32*c* may be centered on the cap, and the base 26 positioned, relative to the throughbore 10*b*, so that the path 32*c* is always aligned with the passage 18 whenever the housing 12 is joined to the base. In such case, rotational orientation of the canister 34 and cap 32 is not critical, and the keying combinations of lugs and slots as described hereinbefore are not required.

It will be appreciated that the present invention provides a dispensing device, particularly applicable to use with shower facilities, for selectively dispensing one or more fluids by introducing such fluids into a primary fluid flow carried by a conduit. The foregoing disclosure and description of the invention is illustrative and explanatory thereof, and various changes in the details of the illustrated apparatus may be made within the scope of the appended claims without departing from the spirit of the invention.

I claim:

1. Dispensing apparatus comprising:

(a) conduit means for conducting a first fluid flow;

(b) housing means for holding fluid for selective dispensing by introduction of said fluid from said housing means into said first flow, and including a plurality of chambers such that each said chamber may hold a separate supply of fluid for said selective dispensing;

(c) passage means for selectively conduting a second fluid flow from said housing means to said conduit means for selectively introducing said fluid from said housing means into said first fluid flow;

(d) control means selectively movable, by manipulation of said housing means relative to said conduit means, between a first configuration in which said second fluid flow may be so conducted from at least any one of said chambers at a time, and a second configuration in which said fluid flow is interrupted, said control means including base means fixed, relative to said conduit means, and cap means, as part of said housing means, whereby said base cooperates with said cap means to releaseably connect said housing means to said conduit means, and said cap means includes path means for communicating said chambers with said passage means for conducting said second fluid flow from said chambers;

(e) seal means for selectively sealing said conduit means to said housing means; and (f) wherein said housing means is movable between a first translational position, in which case said control means is in said first configuration with said seal means sealing said conduit means to said housing means and said path means communicates at least one of said chambers with said passage means, and a second translational position, in which case said control means is in said second configuration and said path means does not communicate any chamber with said passage means.

2. Dispensing apparatus as defined in claim 1 wherein said housing means may be rotated in said second translational position to select chambers for communication with said passage means by alignment of corresponding path means, corresponding to said selected chambers, with said passage means.

3. Dispensing apparatus as defined in claim 2 further comprising first key means for permitting movement of said housing means from said second to said first translational position when one said path means is aligned with said passage means, and for preventing said movement of said housing means from said second to said first translational position when no path means, corresponding to a chamber, is aligned with said passage means.

4. Dispensing apparatus as defined in claim 3 wherein said first key means includes lug means carried by one of said housing means or base means, and slot means carried by the other, and prevents rotational motion of said housing means, in said first translational position, relative to said base means.

5. Dispensing apparatus as defined in claim 4 further comprising first anchoring means, included in said base means and said cap means, whereby said first anchoring means is releaseably engageable, when said housing means is in said first or second translational positions, for releaseably holding said housing means fixed against translational motion relative to said conduit means when said housing means is in said first or second translational position.

6. Dispensing apparatus as defined in claim 5 wherein said housing means further includes canister means, containing said chamber means, and releaseably engageable to said cap means.

7. Dispensing apparatus as defined in claim 6 further comprising tube means for communicating said path means with said chambers.

8. Dispensing apparatus as defined in claim 7 further comprising second key means for rotationally aligning said canister means with said cap means.

9. Dispensing apparatus as defined in claim 8 wherein said second key means includes lug means carried by one of said cap means or canister means, and slot means carried by the other.

10. Dispensing apparatus as defined in claim 9 further comprising second anchoring means for releaseably engaging said cap means to said canister means.

11. Dispensing apparatus as defined in claim 10 wherein said conduit means is equipped with reduced cross section means for reducing the cross-sectional area of the first fluid flow, and said passage means is positioned to introduce said second fluid flow into said first fluid flow within said reduced cross-sectional area of said first fluid flow.

12. Dispensing apparatus as defined in claim 2 wherein said housing means further includes canister means, containing said chamber means, and releaseably engageable to said cap means.

13. Dispensing apparatus as defined in claim 12 further comprising tube means for communicating said path means with said chambers.

14. Dispensing apparatus as defined in claim 12 wherein said conduit means is equipped with reduced cross section means for reducing the cross-sectional area of the first fluid flow, and said passage means is positioned to introduce said second fluid flow into said first fluid flow within said reduced cross-sectional area of said first fluid flow.

15. Dispensing apparatus as defined in claim 1 wherein said housing means further includes canister means, containing said chamber means, and releaseably engageable to said cap means.

16. Dispensing apparatus as defined in claim 15 wherein said conduit means is equipped with reduced cross section means for reducing the cross-sectional area of the first fluid flow, and said passage means is positioned to introduce said second fluid flow into said first fluid flow within said reduced cross-sectional area of said first fluid flow.

17. Dispensing apparatus as defined in claim 1 wherein said conduit means is equipped with reduced cross section means for reducing the cross-sectional area of the first fluid flow, and said passage means is positioned to introduce said second fluid flow into said first fluid flow within said reduced cross-sectional area of said first fluid flow.

18. Aspirator apparatus for dispensing fluid material comprising:

(a) conduit means for conducting a primary fluid flow for carrying said material to be dispensed;

(b) housing means, equipped with a plurality of chambers for holding said material;

(c) passage means for conducting said material to said primary fluid flow;

(d) control means, operable by manipulation of said housing means relative to said conduit means, for selectively permitting flow of material from said chambers to said passage means for conduction to said primary fluid flow, and for selectively preventing said flow of material from said chambers to said passage means; and (e) seal means which sealingly communicates said passage means to said housing means for conducting material from said chambers to said passage means, but which is disengaged from such communication by said control means when flow of material from said chambers to said passage means is prevented by said control means.

19. Apparatus as defined in claim 18 wherein said conduit means is in line with a shower head facility, and said primary fluid flow is the water stream conducted to said shower head facility.

* * * * *